United States Patent [19]

Vydrin et al.

[11] 4,244,204

[45] Jan. 13, 1981

[54] MILL STAND

[76] Inventors: Vladimir N. Vydrin, ulitsa Timiryazeva, 28, kv. 27; Valery V. Pastukhov, ulitsa Stalevarov, 28-a, kv. 79; Leonid A. Barkov, ulitsa Klary Tsetkin, 30-a, kv. 13; Pavel M. Sychev, ulitsa Timiryazeva, 36, kv. 3; Sergei I. Dolgov, prospekt Lenina, 68, kv. 20, all of Chelyabinsk; Dmitry S. Novikov, Leninsky prospekt, 49, kv. 20, Moscow; Sergei A. Mymrin, ulitsa Shirshova, 7, kv. 55, Chelyabinsk; Pulat S. Maxudov, ulitsa Metallurgov, 9, kv. 4, Chirchik; Nikolai N. Sergeev, ulitsa Metallurgov, 5, kv. 4, Chirchik; Anatoly A. Shegai, ulitsa Sportivnaya, 46, kv. 44, Chirchik, all of U.S.S.R.

[21] Appl. No.: 958,334

[22] Filed: Nov. 7, 1978

[51] Int. Cl.[3] ..... B21B 13/10; B21B 31/02

[52] U.S. Cl. ..... 72/224; 72/237

[58] Field of Search ..... 72/224, 234, 235, 238, 72/249, 237

[56] References Cited

U.S. PATENT DOCUMENTS

| | | | |
|---|---|---|---|
| 133,059 | 11/1872 | Rothwell | 72/224 |
| 371,424 | 10/1887 | Clifford et al. | 72/224 |
| 2,003,551 | 6/1935 | Nygren et al. | 72/224 |
| 2,041,271 | 5/1936 | Stuting | 72/224 |
| 2,053,694 | 9/1936 | Buchels et al. | 72/224 |
| 2,950,934 | 8/1960 | Uebing | 72/224 X |
| 3,142,208 | 7/1964 | Properze | 72/224 X |
| 3,380,278 | 4/1968 | Dilling | 72/224 |

FOREIGN PATENT DOCUMENTS

| | | | |
|---|---|---|---|
| 208643 | 1/1968 | U.S.S.R. | 72/237 |

*Primary Examiner*—Milton S. Mehr

*Attorney, Agent, or Firm*—Fleit & Jacobson

[57] ABSTRACT

A mill stand has a roll housing which mounts chocks provided with cantilevered axles carrying workrolls with at least one axle being connected with a spindle geared to a drive. The spindle of at least one workroll is positioned in direct proximity with the axle which carries this workroll, on the side of its free end. Such mill stand construction makes it possible to effect rolling of difficult-to-form metals and alloys.

4 Claims, 9 Drawing Figures

MILL STAND

This invention pertains to rolling mills and more in particular to a mill stand. The mill stand of the invention is especially suitable for use in the production of articles from difficult-to-form and low-ductile metals and alloys, for example, those based on nickel, tungsten, molybdenum, niobium.

BACKGROUND OF THE INVENTION

At present a great variety of articles from difficult-to-form metals and alloys are finding an ever wider application in various fields of science and technology. However, their industrial production is labor-consuming and involves substantial losses of difficult to obtain and expensive metals and alloys. For example, it is known to industrially manufacture bars of 35 to 40 mm in diameter from a number of heat-resistant nickel alloys subjected to rolling on duo mills, smaller bar sections being obtained by means of mechanical treatment.

Bar or wire stock from difficult-to-form metals, such as tungsten and molybdenum, is produced by means of open die forging or roll forging. Such processess are labor-consuming, involve high expenses and are characterized by hard working conditions and low production output. Unfavorable stress conditions of metal during forging or rolling on duo mills, accompanied by free expansion of metal, lead to the formation of cracks and lamination, also resulting in the nonuniform working of metal structure across the entire section of workpieces. This, in turn, requires additional mechanical treatment of such workpieces, resulting in substantial losses of expensive metals. As a consequence, the yield of finished product is considerably lowered and the desired quality of the finished product can not be ensured.

It has been found that difficult-to-form metals and alloys lend themselves readily to working in multiroll passes formed by three, four or more rolls arranged in one plane. Favorable stress conditions created in such passes enable all-round reduction of metal, thereby increasing plasticity of metals and alloys. The rolling effected in multiroll passes is characterized by substantially low degree of metal expansion and high degree of metal reduction per pass. These favorable features are conducive to the production of high-quality rolled products, such as bar sections and wires.

It should be mentioned, however, that the prior-art roll stand constructions with multi-roll passes are intended mainly for rolling low-alloy steels, being unsuitable for rolling difficult-to-deform metals and alloys which are characterized by high resistance to deformation, exceeding 4 to 8 times the resistance to deformation shown by low-alloy steels. The known roll stands with multiroll passes have a constructional disadvantage which resides in that the space adapted to accommodate the bearings of workrolls is rather limited. In widely known constructions of multi-roll pass mill stands the bearings are mounted on both ends of the axle which carries a workroll; hence these is a limited size of the bearings and, as a consequence, low load capacity of the workroll.

There are known mill stands which comprise a roll housing adapted to mount chocks provided with cantilevered axles. Mounted on the axles are workrolls which accommodate bearings resting on the said cantilevered axles. The axles are made hollow with a view to receive spindles which are connected with the workrolls through the intermediary of gear drives (cf. U.S.S.R. Inventor's Certificate No. 208,643).

The arrangement of the bearings within the workrolls in the roll stand mentioned above makes it possible to increase the bearings in size and, consequently, to increase loading capacity of the workroll.

In the known roll stand, however, the spindles are mounted in the hollow interior of the cantilevered axles, with the size of the spindle being limited by the axle interior space which, if increased, will result in the lower strength of the cantilevered axle.

The aforementioned disadvantage renders it impossible to supply a required torque to workrolls, which torque occurs in the process of rolling difficult-to-form metals and alloys.

What is required is a mill stand constructed so as to provide for such special arrangement of spindles relative to the work-roll carrying axles that, without increasing the roll stand dimensions, it will permit the workrolls to take up substantially higher degree of rolling load and relatively great torque to be supplied to said workrolls, thereby enabling rolling of difficult-to-form metals and alloys.

SUMMARY OF THE INVENTION

The invention provides a mill stand having a roll housing which mounts chocks provided with cantilevered axles carrying workrolls with at least one axle being connected with a spindle geared to a drive, wherein, according to the invention, the spindle of at least one of the workrolls is positioned in direct proximity with and on the side of the free end of the axle carrying this workroll.

It is preferable that at least one of the chocks be formed with facets converging at an angle, each facet having the workroll-carrying axle mounted on and normally extended thereto.

Such arrangement of the chocks permits substantial reduction of the structural elements in the mill stand, thereby rendering it simple in construction and easy in operation.

It is advantageous to connect the workroll with the spindle through a sleeve having its inner face formed with teeth brought in to engagment with barrel-shaped teeth formed in the spindle; the outer face of the sleeve is formed with splines brought into engagement with splines formed in the body of the workroll, with the area of contact between the splines of the sleeve and the workroll exceeding the area of contact between the barrel-shaped teeth of the spindle and the teeth of the sleeve.

The sleeve of this type permits contact stress to be substantially reduced at the place of connection between the spindle and the body of a workroll, as well as between the spindle and the drive connecting shaft. In this case, the elements subject to maximum wear are those which are easily removable, the sleeve and spindle, whereas the workroll and the drive shaft undergo insignificant degree of wear and thus have long service life.

The workroll-carrying axle is preferably formed with a coaxially disposed opening adapted to receive a screw provided with a head which rests upon the inner race of the workroll bearing and is larger in diameter than the spindle.

The provision of the screw of this type in the cantilevered axle makes it possible to rapidly effect mounting and dismounting the workroll together with bearings from the cantilevered axle by simple and effective means.

The mill stand of the invention is superior to the prior-art mill stands of similar size in that the load capacity of its workrolls is 1.5 to 2 times higher owing to the arrangement of bearings inside the workrolls, with the torque supplied to the workrolls being 3 to 4 times greater due to the disposition of spindles on the side of free ends of the cantilevered axles. The provision of chocks, each carrying two workrolls, permits the roll stand to be rendered simple in construction and easy in operation.

From the above it follows that the mill stand of the invention is readily adaptable for effective rolling of difficult-to-form low-ductile metals and alloys of high strength, enabling substantial degree of drawing to be effected in a single pass and high-quality products to be obtained at relatively insignificant losses of difficult to obtain and expensive metal.

BRIEF DESCRIPTION OF THE DRAWINGS

The invention will be further described, by way of example only, with reference to the accompanying drawings, wherein.

DESCRIPTION OF THE PREFERRED EMBODIMENTS

Figure 1:
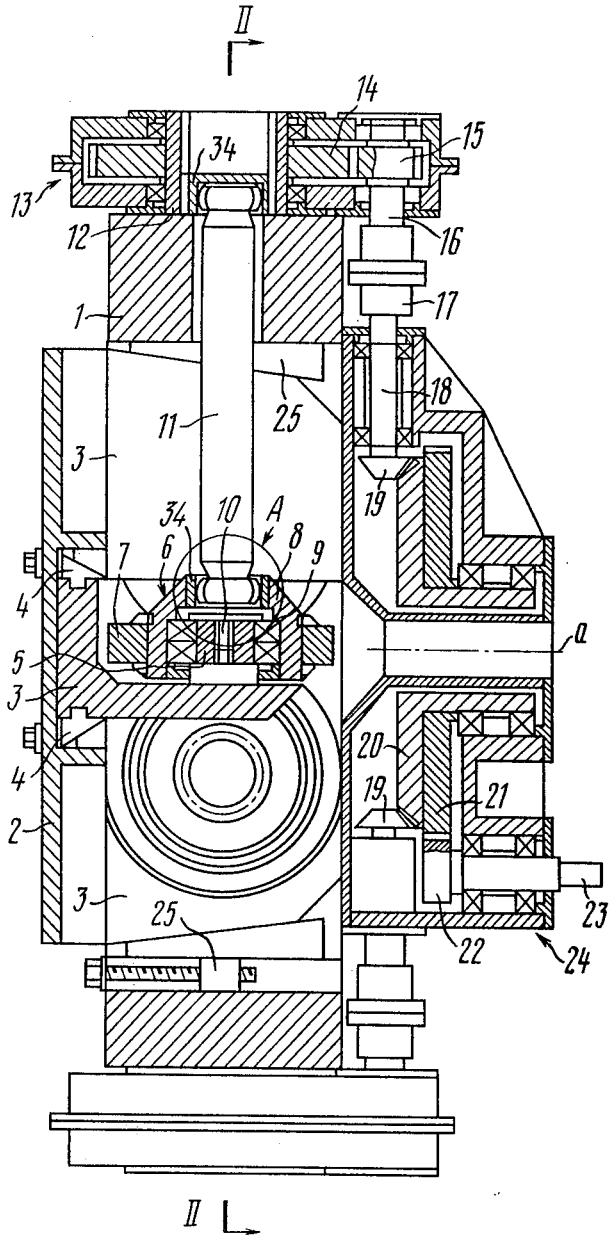
FIG. 1 is a longitudinal sectional view of a mill stand according to the invention, wherein all workrolls are power driven.
Figure 2:
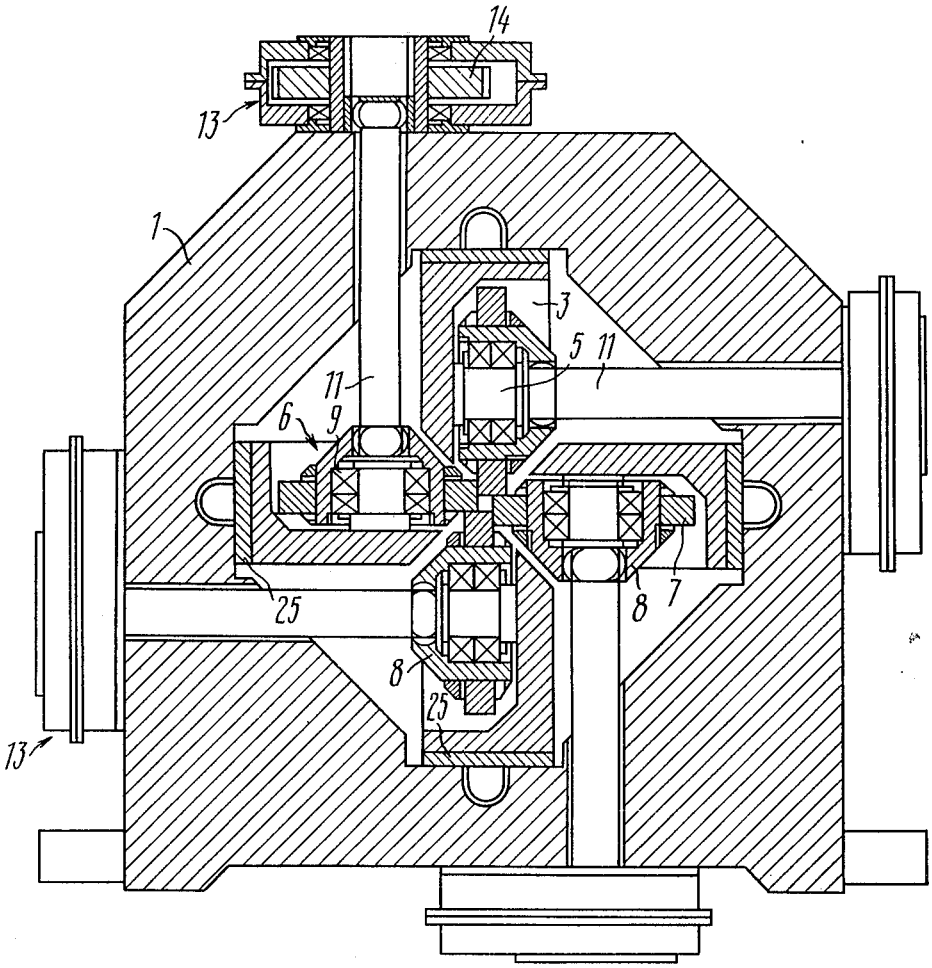
FIG. 2 is a cross section taken along plane II—II of FIG. 1.

Referring now to the drawings, and to FIGS. 1 and 2 in particular, there is shown therein a mill stand with four-roll pass, which comprises a roll housing 1 whereupon rests a box 2 adapted for mounting four chocks 3. The chocks 3 are fixed in the box 2 by means of wedge mechanisms 4 which are also used for moving the chocks as their position is adjusted in a direction transversal relative to the axis "a" of rolling. Cantilevered in each chock 3 is an axle 5 adapted to carry a workroll 6. The workroll 6 comprises a roll sleeve 7 fixedly attached to a body 8 which accommodates bearings 9 mounted on the axle 5 and secured thereto by a screw 10. Spindles 11 are provided to transfer torque to each of the workrolls 6. Each of the spindles 11 is positioned in direct proximity with its axle 5 on the side of its free end. The spindle 11 has one of its ends connected with the body 8 of the workroll 6, the other end thereof being connected with a shaft 12 of a gear reducer 13. The shaft 12 is connected through a gear wheel 14 with a pinion 15 fixedly mounted on a shaft 16 coupled through a sleeve 17 with a shaft 18 carrying a bevel pinion 19 mounted on its end. The bevel pinion 19 is brought into engagement with a bevel gear 20 being coaxially connected with a horizontal wheel 21 brought into engagement with a pinion 22 fixedly mounted on an input shaft 23 of a gear reducer 24. The input shaft 23 is connected with a shaft of an electric motor (not shown). Mounted in the roll housing 1 are wedge mechanisms 25 intended to adjust the chocks 3 in a position radial relative to the axis "a" of rolling.

The fact that the spindle 11 is mounted on the side of the free end of the cantilevered axle 5 makes it possible to form such spindle of any suitable size, thereby enabling a requisite torque to be applied to the working rolls 6, which results in effective rolling of difficult-to-form metals and alloys.

Figure 3:
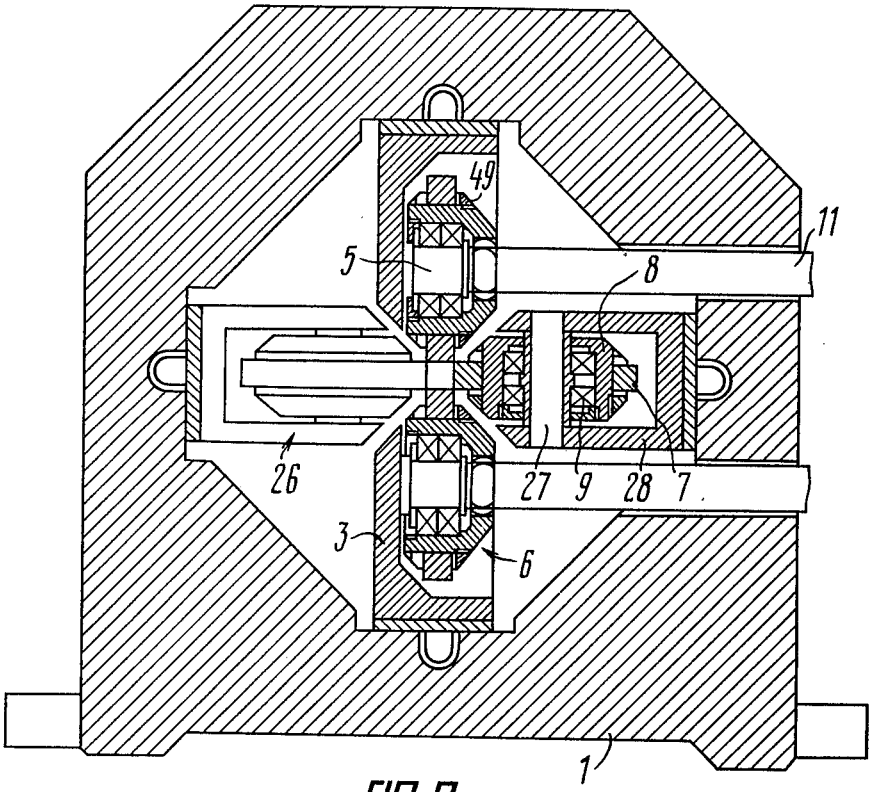
FIG. 3 is a cross-section of a mill stand with a four-roll pass, wherein two workrolls are power driven.

Shown in FIG. 3 is another embodiment of the invention, comprising four workrolls, of which two are driven in a manner similar to that described above. Workrolls 26 are undriven and mounted on axles 27 fixed in chocks 28.

Such structural arrangement of the mill stand permits simple construction of the latter. The spindle 11 can be made of any suitable size, since they are mounted on the free ends of the cantilevered axles 5, which, in turn, allows the supply of torque required for effecting rolling of difficult-to-form metals and alloys.

Figure 4:
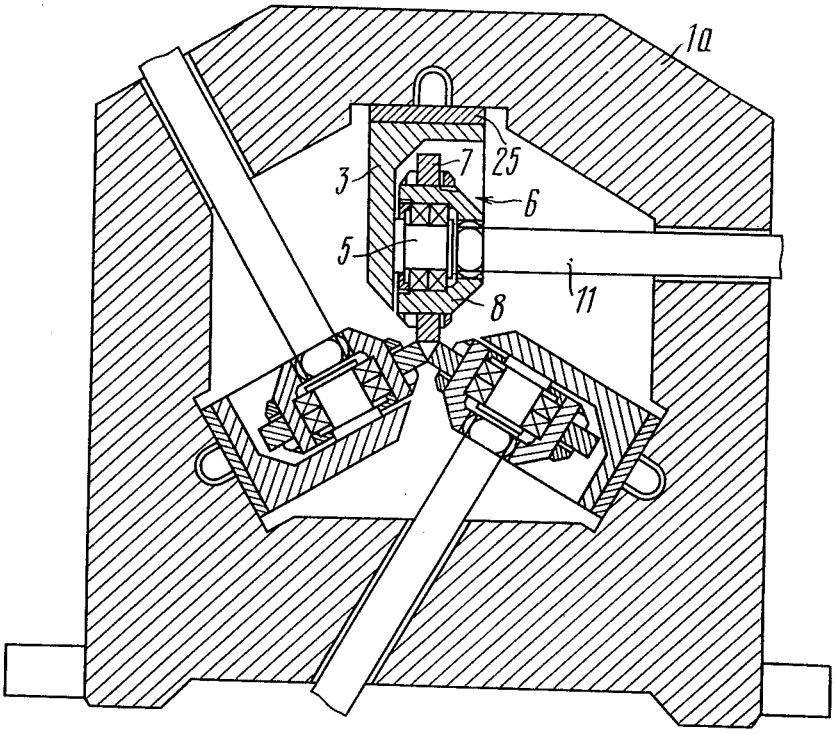
FIG. 4 is a cross section of a mill stand with a three-roll pass, wherein all workrolls are driven.
Figure 5:
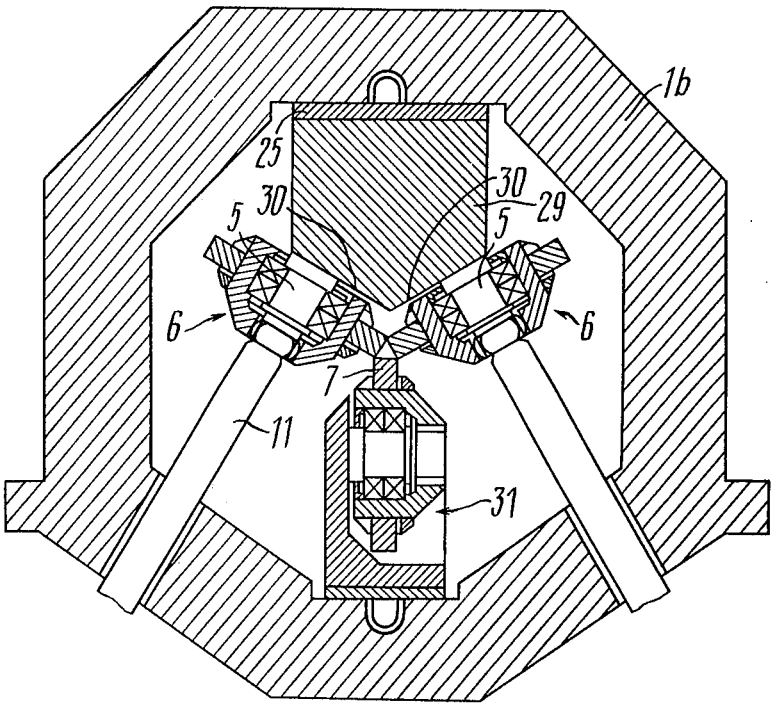
FIG. 5 is a cross section of a mill stand with a three-roll pass, wherein one of the chocks carries two workrolls.

Alternatively, the mill stand of the invention may comprise three rolls 6 mounted on a roll housing 1*a*, such as shown in FIG. 4. All the workrolls 6 are connected through the spindles 11 with a drive (not shown). The disposition of the spindle 11 on the side of the free end of the cantilevered axle 5 permits chock 29 (FIG. 5), fixedly mounted on the roll housing 1*a*, to be formed with two facets 30 converging at an angle. Fixedly attached to each edge 30 and normally extending thereto is the cantilevered axle 5 adapted to carry the workroll 6. The axles 5 secured on the chock 29 are arranged in one plane. Workroll 31 is made undriven. Such construction of the chock 29 permits, without reducing load capacity of the mill stand, the number of structural elements incorporated therein, to be decreased, thereby rendering the mill stand simple in design and easy in operation.

Figure 6:
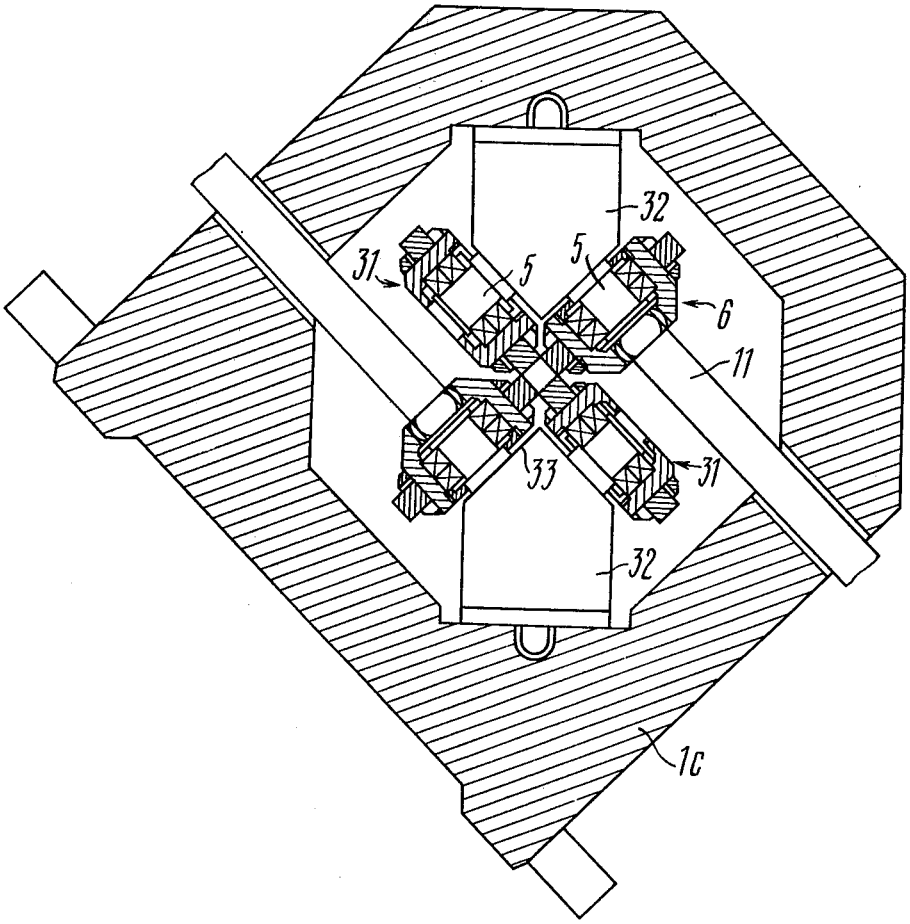
FIG. 6 is a cross section of a mill stand with four-roll pass, wherein each of the two chocks carries two workrolls.

According to another embodiment of the invention shown in FIG. 6, the mill stand comprises four workrolls, with two chocks 32 mounted on a roll housing 1*c* being formed with facets 33 converging at an angle. Secured to said facets are the axles 5 adapted to carry the workrolls 6 and 31. The workrolls 6 are driven whereas the workrolls 31 are undriven.

Such mill stand structural arrangement makes it simple in construction and easy in operation.

Figure 7:
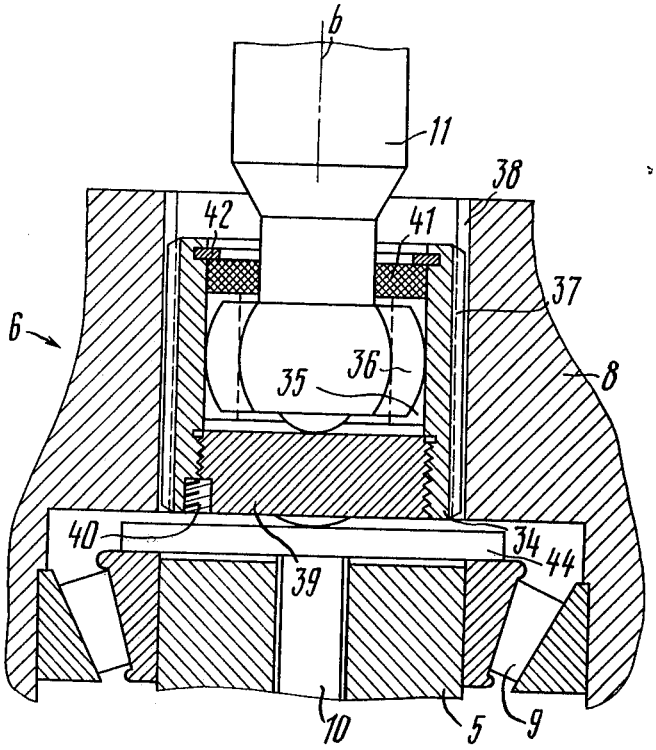
FIG. 7 is an enlarged view of unit A of FIG. 1.

The spindle 11 (FIG. 1) is connected with the body 8 of the workroll 6 through the intermediary of a gear drive. When applying substantially great torque required for effective rolling of difficult-to-form metals and alloys, there arise high contact stresses in the gearing of the spindle 11 with the body 8 of the workroll 6 and with the drive shaft 12, which stresses result in high rate of wear of such large-size and expensive structural elements and members as the body 8 of the workroll 6 and the drive shaft 12. The rate of wear is increased by reason of the inclined operating position of the spindle 11, due to take place during radial adjustment of the workrolls 6. To decrease the rate of wear of the roll body 8 and of the drive shaft 12, the connection of the body 8 of the workroll 6 with the spindle 11 is effected through a sleeve 34 (FIG. 7). The sleeve 34 has its inner face formed with teeth 35, and the spindle 11 is formed with barrel-shaped teeth 36 brought into engagement with the teeth 35 of the sleeve 34. The outer face of the sleeve 34 is formed with splines 37 brought into engagement with splines 38 formed in the body 8 of the workroll 6. The splines 37 and 38 are formed such that the area of contact therebetween is larger than the area of contact between the barrel-shaped teeth 36 of the spindle 11 and the teeth 35 of the sleeve 34, whereby contact stresses on the splines 38 of the roll body 8 are decreased and, consequently, their service life is increased.

The provision of the barrel-shaped teeth 36 on the spindle 11 ensures effective operation of the spindle 11 in inclined position, relative to geometrical axis "b" of the workroll 6, which occurs during radial adjustment of the workroll 6.

To prevent leakage of a lubricant from the interior of the sleeve 34, the latter is closed on one side with a cover 39 fixed by a nut screw 40, and packed with a sealing 41 held by a ring 42, on the other side.

Figure 8:
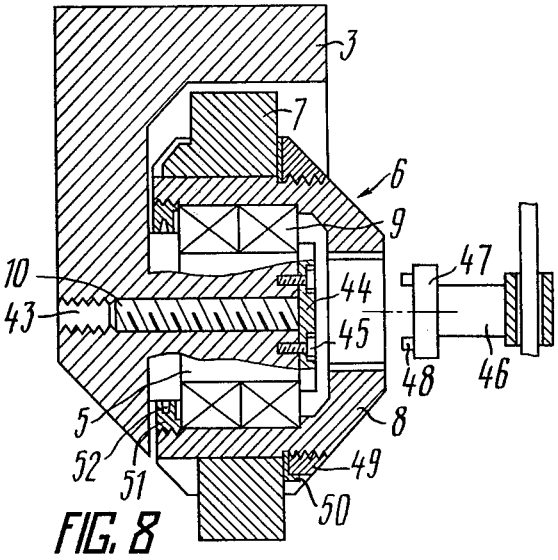
FIG. 8 is a view of a cantilevered axle carrying a workroll secured thereto by means of a screw.
Figure 9:
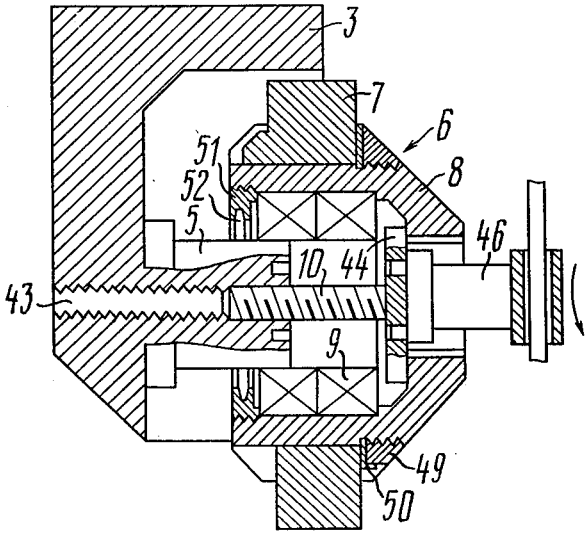
FIG. 9 is the same, with the screw being in a position allowing a workroll to be dismounted from the axle.

To fix the workroll 6 on the cantilevered axle 5 and to remove it therefrom, the axle 5 is formed with a threaded opening 43 (FIGS. 8, 9) disposed coaxially therewith. The opening 43 is adapted to receive a screw 10 whose head 44 is larger in diameter than the spindle 11 with the sleeve 34 (FIG. 7) and rests upon the inner race of the bearing 9 as the workroll 6 is being mounted on the cantilevered axle 5 and then fixed in position by means of a nut screw 45 (FIGS. 8, 9). The screw 10 is also used to remove the workroll 6 from the cantilevered axle 5 and is unscrewed by means of a spanner 46 having its head 47 formed with pins 48 positioned thereon in a manner similar to the disposition of the openings adapted to receive fixing screws 45 and provided on the head 44 of the screw 10. With the screw 10 being unscrewed by means of the spanner 46, the former is thrust up with its head 44, while being moved in the right-hand direction, against the body 8 of the workroll 6, thereby enabling its removal together with the bearings 9 from the axle 5.

The roll sleeve 7 is fixed on the body 8 by means of a nut screw 49 which is held in position by a washer 50. The bearings 9 are fixed in the body 8 by means of a flange 51 with a packing 52.

The mill stand of the invention operates in the following manner.

An electric motor (not shown) supplies torque to the gear reducer 24 through its shaft 23, as well as to the pinion 22 and horizontal wheel 21 mounted coaxially with the bevel gear 20. Enmeshed with the bevel gear 20 are four bevel pinions 19 adapted to transfer torque through the shafts 18 and sleeves 17 to the four gear reducers 13 through the shafts 16, the ends of which carry the pinions 15 adapted to transfer torque to the horizontal wheels 14. Mounted in the interior of the hollow shafts 13 of the horizontal wheels 14 are the sleeves 34 adapted to transfer the torque from the shaft 12 to the spindle 11. The spindles 11 are operable to place the torque to the bodies 8 of the workrolls 6.

The rolling process is effected in a manner similar to that performed at known rolling mills provided with multi-roll passes.

The experimental mill stand according to the invention has been constructed to have four-roll pass. Each of the working rolls, 200 mm in diameter, is capable of taking up a rolling force of up to 1,400 kg, which is twice as much as the load capacity of the prior-art mill stands provided with four-roll passes and having 200 mm diameter workrolls.

All the workrolls in the mill stand are driven, each being supplied with a maximum torque of 250 kgm; the total amount of torque supplied to the four workrolls is 1,000 kgm, which is four times as much as the total amount of torque placed to the workrolls in the prior-art mill stands provided with four-roll passes and having workrolls 200 mm in diameter.

Such high roll-loading characteristics of the mill stand of the invention enable effective rolling of difficult-to-form metals and alloys, such as heat-resistant nickel alloys, refractory tungsten, molybdenum and other metals.

The mill stand of the invention was used for rolling 30 mm diameter billets from especially high-heat-resistant nickel alloys, tungsten, molzbdenum and other metals, which were made into 8-4 mm diameter bars. The drawing per pass amounted to a value of 1.4 to 1.8.

What is claimed is:

1. A mill stand comprising: a roll housing; chocks mounted on said roll housing; axles having first ends non-rotatably fixed to said chocks; workrolls of toroidal shape rotatably mounted on said axles and forming a pass, with at least one of said workrolls being power driven; a drive for rotating said at least one of said workrolls; a spindle driven from and geared to said drive; connecting means for connecting said spindle and said at least one of said workrolls; said connecting means comprising a generally annular member, interconnecting said spindle and said at least one of said workrolls; said spindle being positioned in direct proximity with and on the side of the free end of one of said axles carrying said at least one of said workrolls to thereby permit the application of great force and hence permit rolling of difficult-to-form metals and alloys.

2. A mill stand as claimed in claim 1, wherein at least one of said chocks is formed with facets converging at an angle, each facet having fixed and normally extending thereto one of said axles carrying a workroll.

3. A mill stand as claimed in claim 1, wherein said connecting means connecting one of said workrolls and its associated spindle comprises a sleeve having its inner face formed with teeth brought into engagement with barrel-shaped teeth formed on said spindle, said sleeve having an outer face formed with splines brought into engagement with splines formed in a body of each workroll, with the area of contact between the splines of the sleeve and of the workroll being larger than the area of contact between the barrel-shaped teeth of the spindle and the teeth of the sleeve.

4. A mill stand as claimed in claim 1, wherein the workroll-carrying axle is formed with a coaxially disposed opening adapted to receive a screw provided with a head resting upon an inner race of a bearing of the workroll and exceeding in diameter the diameter of the portion of the spindle positioned closest to the free end of the axle.

* * * * *